US006572462B1

(12) United States Patent
Vanell

(10) Patent No.: US 6,572,462 B1
(45) Date of Patent: Jun. 3, 2003

(54) CARRIER ASSEMBLY FOR CHEMICAL MECHANICAL PLANARIZATION SYSTEMS AND METHOD

(75) Inventor: James F. Vanell, Tempe, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/072,169

(22) Filed: May 4, 1998

(51) Int. Cl.[7] ..... B24B 5/00

(52) U.S. Cl. ..... 451/287; 451/288; 451/41; 451/285

(58) Field of Search ..... 451/287, 288, 451/289, 41, 285, 388, 389, 390, 384

(56) References Cited

U.S. PATENT DOCUMENTS 1,184,496 A * 5/1916 Stenvall ..... 451/384
5,291,692 A * 3/1994 Takahashi et al. ..... 451/390
5,377,451 A * 1/1995 Leoni et al. ..... 451/287
5,398,459 A * 3/1995 Okumura et al. ..... 451/41
5,670,011 A * 9/1997 Togawa et al. ..... 451/41
5,738,568 A * 4/1998 Jujevic et al. ..... 451/288
5,797,789 A * 8/1998 Tanaka et al. ..... 451/289
5,830,806 A * 11/1998 Hudson et al. ..... 451/287
6,019,868 A * 2/2000 Kimura et al. ..... 451/288

* cited by examiner

*Primary Examiner*—Lee D. Wilson
(74) *Attorney, Agent, or Firm*—Kim-Marie Vo

(57) ABSTRACT

A wafer carrier assembly (51) places a semiconductor wafer in angular compliance with a polishing media. The wafer carrier assembly (51) includes a first assembly and a second assembly. The second assembly inclines freely in any direction for providing angular compliance.

23 Claims, 5 Drawing Sheets

-PRIOR ART-

-PRIOR ART-

-PRIOR ART-

CARRIER ASSEMBLY FOR CHEMICAL MECHANICAL PLANARIZATION SYSTEMS AND METHOD

BACKGROUND OF THE INVENTION

The present invention relates, in general, to chemical mechanical planarization (CMP) systems, and more particularly, a carrier assembly used in CMP systems.

Chemical mechanical planarization (also referred to as chemical mechanical polishing) is a proven process in the manufacture of advanced integrated circuits. CMP is used in almost all stages of semiconductor device fabrication. Chemical mechanical planarization allows the creation of finer structures via local planarization and for global wafer planarization to produce high density vias and interconnect layers. Materials that undergo CMP in an integrated circuit manufacturing process include single and polycrystalline silicon, oxides, nitrides, polyimides, aluminum, tungsten, and copper.

At this time, the expense of chemical mechanical planarization is justified for components such as microprocessors, ASICs (application specific integrated circuits), and other semi-custom integrated circuits that have a high average selling price. The main area of use is in the formation of high density multi-layer interconnects required in these types of integrated circuits. Commodity devices such as memories use little or no CMP because of cost.

The successful implementation of chemical mechanical planarization processes for high volume integrated circuit designs illustrates that major semiconductor manufacturers are embracing this technology. Semiconductor manufacturers are driving the evolution of CMP in several areas. A first area is cost, as mentioned hereinabove, CMP processes are not used in the manufacture of commodity integrated circuits where any increase in the cost of manufacture could impact profitability. Much of the research in CMP is in the area of lowering the cost per wafer of a CMP process. Significant progress in the cost reduction of CMP would increase its viability for the manufacture of lower profit margin integrated circuits. A second area is a reduction in the size or footprint of CMP equipment. A smaller footprint contributes to a reduced cost of ownership. Current designs for chemical mechanical planarization tools take up a significant amount of floor space in semiconductor process facility.

A third area being emphasized is manufacturing throughput and reliability. CMP tool manufacturers are focused on developing machines that can planarize more wafers in less time. Increased throughput is only significant if the CMP tool reliability also increases. A fourth area of study is the removal mechanism of semiconductor materials. Semiconductor companies are somewhat reliant on a limited number of chemical suppliers for the slurries or polishing chemistries used in different removal processes. Some of the slurries were not developed for the semiconductor industry, but came from other areas such as the glass polishing industry. Research will inevitably lead to high performance slurries that are tailored for specific semiconductor wafer processes. Advances in slurry composition directly impact removal rate, particle counts, selectivity, and particle aggregate size. A final area of research is post CMP processes. For example, post CMP cleaning, integration, and metrology are areas where tool manufacturers are beginning to provide specific tools for a CMP process.

Accordingly, it would be advantageous to have a chemical mechanical planarization tool that has improved reliability in a manufacturing environment. It would be of further advantage for the chemical mechanical planarization tool to reduce the cost of polishing each wafer.

DETAILED DESCRIPTION OF THE DRAWINGS

In general, chemical mechanical planarization is used to remove material from a processed side of a semiconductor wafer. Ideally, a uniform amount of material is removed across the semiconductor wafer. Any non-uniformity in the polishing process may result in a loss of yield or long term device reliability problems. The future of CMP is clouded by the fact that device/interconnect geometry's are decreasing, which requires greater control and uniformity while wafer sizes are increasing. Currently, semiconductor manufacturers are converting to 200 millimeter and 300 millimeter diameter semiconductor wafers. At this time, it is not certain whether the CMP tool manufacturers can provide equipment capable of meeting requirements for the latest semiconductor processes and larger wafer sizes.

One component that has a significant impact on the quality of a chemical mechanical planarization process is a carrier assembly. The carrier assembly is a component of a CMP tool that holds or supports a semiconductor wafer. The carrier assembly places uniform pressure on the surface of the semiconductor wafer during the polishing process. The carrier assembly is connected to a carrier arm which is a translation mechanism for moving the carrier assembly. The carrier arm and carrier assembly pick up a semiconductor wafer, press the semiconductor wafer against a polishing media to polish the semiconductor wafer, and place the polished semiconductor wafer in a receiving area.

One parameter of a polished wafer that is closely monitored in a chemical mechanical planarization process is the uniformity of polishing. Polishing uniformity is the variation in the amount of material removed across the polished wafer. Uniformity in material removal is achieved by applying equal pressure over the surface of a semiconductor wafer during the polishing process. The carrier assembly is designed to adjust to a condition of equal pressure when the carrier arm places the carrier assembly/semiconductor wafer against the polishing media.

Currently, wafer planarity of 100 angstroms or less is a CMP goal of the semiconductor industry. Wafer planarity of 100 angstroms corresponds to a 2–3 percent variation across a wafer surface. At this time, polishing uniformity is on the order of 5 to 22 percent using CMP tools currently available to semiconductor manufacturers.

Another problem that plagues all CMP tool manufacturers is edge exclusion. Edge exclusion as it relates to CMP is the variable polishing rate experienced at the periphery of the semiconductor wafer. Edge exclusion occurs because material is removed at a different rate at the interior of the wafer versus the periphery of the wafer. Typical edge exclusion is approximately 3 to 6 millimeters from the semiconductor wafer edge. Edge exclusion can produce hundreds of bad die at larger semiconductor wafer sizes and/or smaller device sizes.

Figure 1:
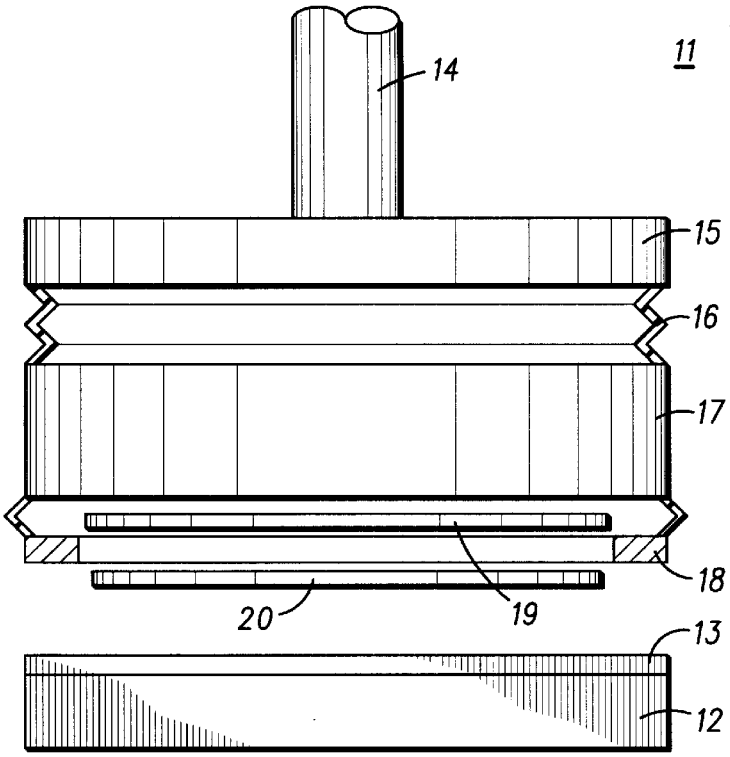
FIG. 1 is an illustration of a prior art carrier assembly using a bellows for angular compliance.

FIG. 1 is an illustration of a prior art carrier assembly using a bellows 16 for angular compliance. Carrier assembly 11 holds a semiconductor wafer 20 during a polishing process. A platen 12 is a support structure for the polishing process. Typically, platen 12 and carrier assembly 11 are both rotating during chemical mechanical planarization. Polishing media 13 is placed on platen 12. Polishing media 13 provides a compliant surface that also allows for the transport of slurry. Ideally, carrier assembly 11 is brought down such that a surface (to be polished) of semiconductor wafer 20 is parallel to the major surface of polishing media 13.

In general, it is not possible to consistently bring carrier assembly 11 exactly parallel to the surface of polishing media 13. Thus, carrier assembly 11 is designed to compensate for a non-parallel condition, which corresponds to a difference in angle between the plane of the surface of semiconductor wafer 20 and the plane of the surface of polishing media 13. The difference in angle that carrier assembly 11 compensates for is typically less than 10 degrees. The act of bringing the surface of semiconductor wafer 20 coplanar to the surface of polishing media 13 is known as angular compliance. Carrier assembly 11 must also place equal pressure across the surface of semiconductor wafer 20 to ensure uniform polishing.

Carrier assembly 11 comprises a drive shaft 14, a drive plate 15, bellows 16, a carrier head 17, a carrier ring 18, and a carrier film 19. Drive shaft 14 is connected to a motor drive (not shown) which rotates carrier assembly 11. Drive plate 15 is circular in shape and forms a base of carrier assembly 11. Drive shaft 14 connects to the center of drive plate 15 for balanced rotation.

Bellows 16 is connected to the periphery of drive plate 15. Bellows 16 is a compensation mechanism that ensures the surface of semiconductor wafer 20 is coplanar to the surface of polishing media 13 during the polishing process. Bellows 16 is also connected to a periphery of a first surface of carrier head 17.

Carrier head 17 has a second surface for supporting semiconductor wafer 20. Carrier film 19 is a compliant material that is attached to the second surface of carrier head 17. Drive shaft 14 is substantially perpendicular to the second surface of carrier head 17 and carrier film 19. Semiconductor wafer 20 is held by vacuum against carrier film 19. Platen 12 and carrier assembly 11 are both rotated during the polishing process. It is not advantageous to allow semiconductor wafer 20 to move or rotate on the carrier assembly 11. Carrier film 19 prevents semiconductor wafer 20 from slipping or rotating during the polishing process. Carrier ring 18 is connected to the periphery of the second surface of carrier head 17. Carrier ring 18 is sized to retain semiconductor wafer 20 from moving outside carrier assembly 11 and to hold it concentrically during a polishing process.

During a planarization process, drive shaft 14 is brought down at an angle substantially perpendicular to the surface of polishing media 13. Polishing chemistry is applied to the surface of polishing media 13. The surface of semiconductor wafer 20 contacts the polishing chemistry on polishing media 13. A predetermined pressure is applied by carrier assembly 11 pressing semiconductor wafer 20 against polishing media 13. The predetermined pressure varies depending on the type of chemical mechanical planarization and the rate of removal required for the process.

The periphery of semiconductor wafer 20 contacts the surface of polishing media 13 first when carrier assembly 11 is brought down due primarily to the fact that drive shaft 14 cannot be made perfectly perpendicular to the surface of polishing media 13. The periphery of semiconductor wafer 20 would be contacting the polishing media at a substantially higher pressure than the inner surface area if carrier assembly 11 did not provide angular compliance with the surface of polishing media 13. The result of non-angular compliance would be unacceptably increased non-uniform polishing ("bullseye") across the surface of semiconductor wafer 20 with excess material removal at the periphery.

Bellows 16 is a compensation mechanism for carrier assembly 11 that brings the surface of semiconductor wafer 20 coplanar to the surface of polishing media 13 when drive shaft 14 is brought down non-perpendicular to the surface of polishing media 13. Bellows 16 compresses in the vertical direction as carrier assembly 11 is brought in contact with polishing media 13. The predetermined force applied by carrier assembly 11 conforms bellows 16 such that the entire surface of semiconductor wafer 20 is coplanar to and coincident with the surface of polishing media 13.

Bellows 16 provides good vertical compensation because it readily compresses or expands as needed. Furthermore, bellows 16 is placed around the entire periphery of carrier head 17 allowing continuous and equal compensation as carrier assembly 11 is rotated. Bellows 16 is the rotational drive mechanism for carrier head 17. Bellows 16 is typically made of metal to withstand the harsh chemical environment of a CMP process. Bellows 16 is not a stamped component made from a single piece of metal, but is made of different diameter rings welded together. The complex manufacturing process of bellows increases the cost of a CMP tool. Additionally, extreme torsional stress is placed on the welds as carrier head 17 rotates during the polishing process. A weld of bellows 16 will fatigue after polishing hundreds of semiconductor wafers, which may damage wafers or result in polishing non-uniformity.

As mentioned previously, carrier assembly 11 is brought down to apply a predetermined and ideally uniform pressure on the surface of semiconductor wafer 20, which corresponds directly to the rate of material removal. Bellows 16 should uniformly compress under ideal conditions. However, the pressure applied by carrier assembly 11 varies when the surface of semiconductor wafer 20 is brought into angular compliance with the surface of polishing media 13. The reason for the variation in applied pressure across the face of semiconductor wafer 20 is due to the fact that bellows 16 is a spring. The area of semiconductor wafer 20 contacting polishing media 13 first will compress bellows 16 more than would occur under ideal conditions. The force applied to the surface of semiconductor wafer 20 corresponds to the amount of compression of bellows 16, thus the polishing process is performed at a pressure different than the predetermined pressure. Rotating carrier assembly 11 allows polishing uniformity to be maintained within the range mentioned hereinabove albeit at a different removal rate of material.

Figure 2:
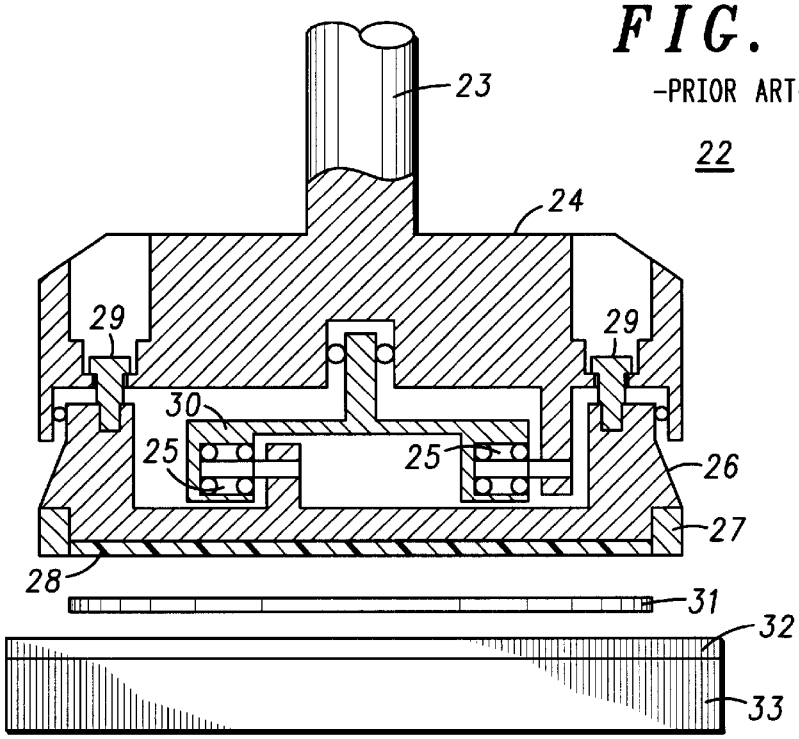
FIG. 2 is an illustration of a prior art carrier assembly using a universal joint for angular compliance.

FIG. 2 is an illustration of a prior art carrier assembly 22 using a universal joint for angular compliance. Carrier assembly 22 performs the same function as carrier assembly 11 in FIG. 1. Universal joints are commonly used in the automotive industry to connect rotating assemblies operating in different planes. For example, an drive shaft connecting a differential to the engine of an automobile often uses universal joints. The differential is connected to the suspension of the vehicle thus is constantly changing position in relation to the engine, which is in a fixed position. Carrier assembly 22 comprises a drive shaft 23 a carrier drive plate 24, roller bearings 25, a carrier head 26, a carrier ring 27, a carrier film 28, pins 29, and center cross 30.

A semiconductor wafer 31 is held by carrier assembly 22 with a major surface exposed for a polishing process. Semiconductor wafer 31 is held against compliant carrier film 28. A platen 33 is a rotating support structure. A polishing media 32 is placed on platen 33 for providing a compliant surface for polishing the surface of semiconductor wafer 31. Polishing chemistry is placed on polishing media 32. Polishing media 32 is also designed to transport polishing chemistry to the surface of semiconductor wafer 31 during the polishing process. In general, both carrier assembly 22 and platen 33 are rotating during the polishing process.

As mentioned hereinabove, carrier assembly 22 brings the surface of semiconductor wafer 31 into angular compliance (coplanar) with the surface of polishing media 32. Center cross 30 is held centered within an opening of carrier drive plate 24 by an o-ring. The o-ring allows center cross 30 to pivot. Center cross 30 connects to roller bearings 25. Center cross 30 and roller bearings 25 form a universal joint connecting carrier drive plate 24 to carrier head 26. The universal joint allows carrier head 26 to move such that the surface of semiconductor wafer 31 is coplanar to the surface of polishing media 32 while the rotational motion of carrier drive plate 24 is transferred to carrier head 26. Pins 29 are guide pins that control rotational movement of carrier head 26 in relation to carrier drive plate 24. Pins 29 are connected to carrier head 26 and fit within a recess formed in carrier drive plate 24. Performance of carrier assembly 22 is limited by the ability of the universal joint to provide angular compliance between semiconductor wafer 31 and polishing media 32. The universal joint, by nature, does not provide equal force consistently across the surface of semiconductor wafer 20 as it rotates. Thus, carrier assembly 22 does not remove material uniformly across the entire wafer surface. Uniformity problems will increase as wafer fabrication facilities convert to 200 and 300 millimeter semiconductor wafers.

Figure 3:
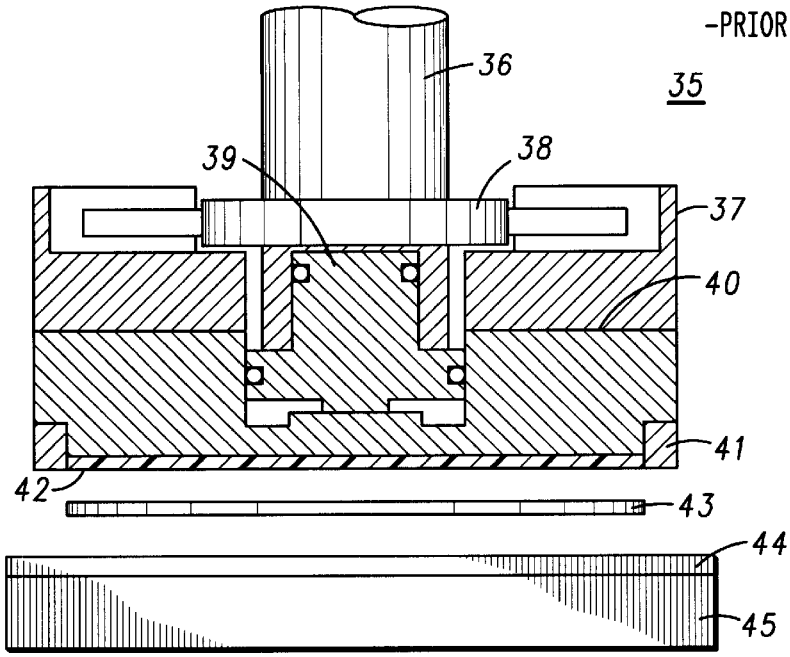
FIG. 3 is an illustration of a prior art carrier assembly using mechanical deflection for angular compliance.

FIG. 3 is an illustration of a prior art carrier assembly 35 using mechanical deflection for angular compliance. Carrier assembly 35 comprises a carrier drive shaft 36, a carrier drive plate 37, a carrier drive ring 38, a carrier button 39, a carrier plate 40, a carrier ring 41, and a carrier film 42. Angular compliance is achieved via mechanical deflection of carrier button 39 that allows carrier plate 40 to move in relation to carrier drive shaft 36.

Carrier drive shaft 36 connects to a motor assembly (not shown) for rotating carrier assembly 35. Carrier button 39 is fitted into carrier drive shaft 36. Carrier drive ring 38 connects to both carrier drive shaft 36 and carrier drive plate 37. Carrier drive ring 38 rotates carrier drive plate 37 while allowing angular compensation. An opening is formed centrally through carrier drive ring 38 and through carrier drive plate 37. Carrier drive shaft 36 and carrier button 39 are placed through the openings of carrier drive ring 38 and carrier drive plate 37.

Carrier drive plate 37 is connected to carrier plate 40. Carrier plate 40 has a centrally located opening that is not formed completely through the structure. A surface of carrier button 39 rests against a horizontal surface of carrier plate 40. Carrier button 39 transmits a vertical force to carrier plate 40 that is distributed to a surface of a semiconductor wafer 43. A side wall of carrier button 39 is spaced from a side wall (in the opening) of carrier plate 40. An o-ring is placed in the side wall of carrier button 39 that contacts the surface of the side wall of carrier plate 40. The o-ring is compliant allowing carrier drive plate 37 and carrier plate 40 to move to achieve angular compliance with the plane of the surface of polishing media 44. The o-ring compresses as carrier plate 40 tilts. The side wall of carrier button 39 does not contact the side wall of carrier plate 40 under normal operating conditions during a polishing process.

Semiconductor wafer 43 is held by carrier assembly 35 exposing a surface for a polishing process. Semiconductor wafer 43 is held against compliant carrier film 42. A platen 45 is a rotating support structure for the polishing process. A polishing media 44 is placed on platen 45 for providing a compliant surface for polishing the surface of semiconductor wafer 43 and for the transport of polishing chemistry. Carrier assembly 35 is brought down vertically contacting the surface of semiconductor wafer 43 to the surface of polishing media 44. The vertical force is transmitted through the interface between carrier button 39 and carrier plate 40. In general, both carrier assembly 35 and platen 45 are rotating during the polishing process.

As mentioned hereinabove, carrier assembly 35 brings the surface of semiconductor wafer 43 into angular compliance (coplanar) and coincident with the surface of polishing media 44. The amount of angular compliance that can be compensated for is directly related to the mechanical spacings in the system. Increasing the spacings to achieve a wider range of angular compliance would reduce the uniformity of the polishing process, so there is an inherent compromise in the design. Moreover, the flat surface of carrier button 39 contacting the corresponding surface of carrier plate 40 wears and deforms with time thereby changing the angular compliance characteristics of carrier assembly 35. Should carrier button 39 wear unevenly, the force applied to carrier plate 40 will be unequal which produces non-uniform polishing across the surface of semiconductor wafer 43.

Figure 4:
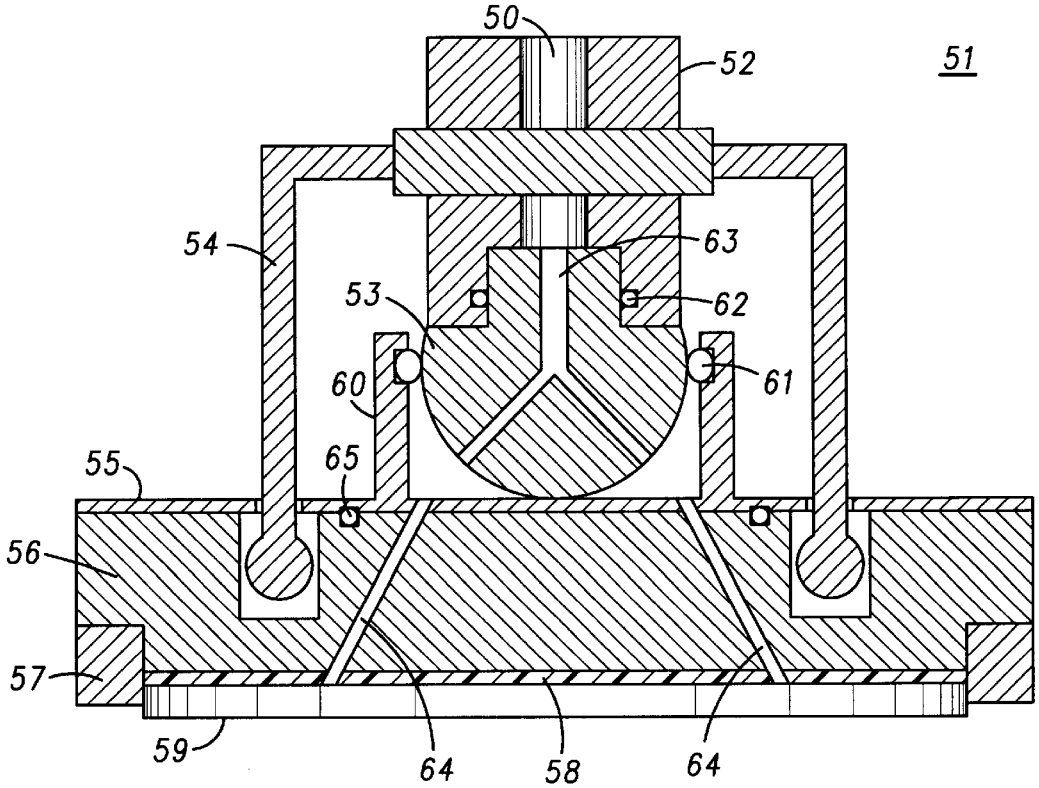
FIG. 4 is a cross-sectional view of a carrier assembly in accordance with the present invention.

FIG. 4 is a cross-sectional view of a carrier assembly 51 in accordance to the present invention that provides angular compliance while applying a uniform force across a surface of a semiconductor wafer 59 during a polishing process. Carrier assembly 51 comprises a first assembly and a second assembly. The design permits the second assembly to incline freely in any direction to ensure the surface of semiconductor wafer 59 is coplanar to a surface of a polishing media during the polishing process. The uniform force is accurately controlled and does not degrade over time.

The first assembly comprises a drive shaft 52, an angular compliant device 53, and a drive mechanism 54. Drive shaft 52 is connected to a motor assembly (not shown) for rotating carrier assembly 51. Drive shaft 52 includes a channel for providing a gas or vacuum. Vacuum port 50 is an opening in drive shaft 52 for connecting to a gas or vacuum line.

Drive mechanism 54 connects to drive shaft 52 and includes a structure that rotates the second assembly. In one embodiment of drive mechanism 54, a drive spider is employed to rotate the second assembly. The drive spider has four arms that are concentrically located to the second assembly. Each arm is located 90 degrees from an adjacent arm for providing balanced drive to the second assembly. As shown, each of the spider drives preferably ends in a sphere. The sphere fits into a cavity of the second assembly. The side walls and bottom of the cavity are spaced from a corresponding sphere such that the second assembly inclines freely. Rotating drive shaft 52 causes each sphere of the drive spider to contact a corresponding side wall of the cavity to rotate the second assembly.

Angular compliant device 53 fits into drive shaft 52 leaving a curved surface exposed for contacting the second assembly. Angular compliant device 53 contacts a flat surface of the second assembly. The second assembly inclines across the curved surface of angular compliant device 53. Preferably, a contact area between the first and second assembly is a point contact. In an embodiment of carrier assembly 51, point contact is made by contacting the curved surface of angular compliant device 53 with a flat surface of the second assembly. The uniform pressure applied by carrier assembly 51 across the surface of semiconductor wafer 59 is transferred through the contact area between angular compliant device 53 and the flat surface of the second assembly. Material limitations of the curved surface increase the contact area from a point contact to a finite area. Although the contact area is determined by material limitations, the contact area is small enough where it is substantially a point contact. A rolling motion would not be achieved between the curved and flat surfaces (for angular compliance) if the contact area is made too large. Angular compliant device 53 includes a passage way 63 that connects to the channel of drive shaft 52 for providing gas or vacuum. An o-ring 62 seals angular compliant device 53 to drive shaft 52 to prevent leakage of gas or vacuum.

The second assembly comprises a cover plate 55, a carrier plate 56, a carrier ring 57, and a carrier film 58. In an embodiment of carrier assembly 51, angular compliant device 53 contacts a central area of cover plate 55. Cover plate 55 includes a rigid planar surface that distributes the force applied to the contact area between angular compliant device 53 and cover plate 55 across the entire surface of semiconductor wafer 59 during the polishing process. Openings are formed in cover plate 55 for the arms of the drive spider. Cover plate 55 also includes a housing 60 for angular compliant device 53. An o-ring 61 seals housing 60 to angular compliant device 53. O-ring 65 seals cover plate 55 to carrier plate 56 to prevent gas or vacuum leaks. Vacuum or gas is provided to housing 60 via angular compliant device 53. Passage ways 64 are formed through cover plate 55, carrier plate 56, and carrier film 58. Passages 64 connect to housing 60 for providing vacuum or gas to a surface of carrier film 58. Vacuum is used to hold semiconductor wafer 59 to carrier film 58 during the polishing process. Gas is used to eject semiconductor wafer 59 from carrier assembly 51 after the polishing process is completed. Gas is also used to apply back-pressure to the backside of semiconductor wafer 59 during the polishing process.

Carrier plate 56 connects to cover plate 55 and forms the body of the second assembly. The cavities for drive mechanism 54 are formed in carrier plate 56. Carrier film 58 is connected to carrier plate 56 to provide a compliant surface for mounting semiconductor wafer 59 to the second assembly. Carrier ring 57 connects to carrier plate 56 to retain semiconductor wafer 59 from moving off as well as keeping semiconductor wafer 59 concentric to the second assembly during the polishing process.

Ideally, drive shaft 52 of the first assembly is positioned at a 90 degree angle to the surface of the polishing media surface. Under this.condition, the surface of cover plate 55 and the surface of semiconductor wafer 59 is also perpendicular to drive shaft 52. This is the only condition in which the surface of semiconductor wafer 59 is brought into coplanar contact with the surface of the polishing media without angular compensation. In normal operation, it is difficult to place drive shaft 52 perpendicular to the surface the polishing media. This results in accelerated polishing on the periphery (bullseye) as measured by the non-uniform removal of material across the surface of semiconductor wafer 59. As mentioned previously, carrier assembly 51 is designed to allow the second assembly to incline freely in any direction in relation to the first assembly. Carrier assembly 51 is brought down until the surface of semiconductor wafer 59 contacts the surface of the polishing media. Angular compliance is achieved by cover plate 55 rolling across the curved surface of angular compliant device 53 until the surface of semiconductor wafer 59 is coplanar to and coincident with the surface of the polishing media. It should be noted that the second assembly naturally moves to a position of coplanarity as semiconductor wafer 59 contacts the polishing media. The flat surface of rigid cover plate 55 contacting a small area of angular compliant device 53 allows the pressure from carrier assembly 51 to be distributed evenly across the entire surface of semiconductor wafer 59 thereby removing material uniformly during the polishing process.

In general, it is not advantageous to have both cover plate 55 and angular compliant device 53 made from hard materials. Either cover plate 55 or angular compliant device 53 would wear over time which could affect polishing uniformity. Cover plate 55 preferably is made of a rigid, hardened material to transfer the pressure from a single contact area from angular compliant device 53 evenly across the entire surface of semiconductor wafer 59. Cover plate 55 should also be resistant to a harsh chemical environment. In an embodiment of carrier assembly 51, cover plate 55 is made of hardened stainless steel which is rigid, wear resistant and impervious to chemicals used in the polishing process.

Angular compliant device 53 is made of a material that is more compliant than the material used to form cover plate 55, but resistant to chemicals used in chemical mechanical planarization. A suitable characteristic of the material used for angular compliant device 53 is that it is capable of undergoing elastic deformation even under significant compressive stress loading. In other words, the material is capable of compressing, but will return to it's original shape. An example of materials that are capable of under going elastic deformation are polymeric materials such as polyphenylene sulfide (PPS), polyetheretherketone (PEEK), or homopolymeracetal, which is sold under the trademark Delrin®. These plastic materials are easily formed or machined to have a curved surface. Moreover, the design of angular compliant device 53 is inexpensive and allows for easy removal and replacement during normal maintenance of a chemical mechanical planarization tool.

Proper design of angular compliant device 53 ensures uniform polishing of thousands of semiconductor wafers. Examples of angular compliant device 53 for 200 millimeter and 300 millimeter diameter semiconductor wafers is described hereinafter. The examples are designed for a curved surface corresponding to a sphere. Angular compliant device 53 is not limited to spherical shapes and is easily designed for other curved surfaces, for example, ellipsoidal. The curved surface dictates the contact area between angular compliant device 53 and cover plate 55. The contact area is a function of the pressure being applied and the material characteristics for angular compliant device 53. The rate of curvature is selected to allow the contact area to stay in a range where angular compliant device 53 elastically deforms under normal operating pressures.

In the calculations, cover plate 55 is assumed not to deform under the pressure applied by angular compliant device 53 for a chemical mechanical planarization process using large diameter semiconductor wafers (e.g., 200 to 300 millimeters). The material of angular compliant device 53 compresses when pressed against cover plate 55. Angular compliant device 53 must stay in an elastic deformation state under maximum pressure conditions in the polishing process. Permanent deformation or plastic deformation occurs if the imposed stress causes the compressive elastic limit of the material to be exceeded. Polishing uniformity degrades and angular compliant device 53 will wear should plastic deformation occur. An example of a maximum polishing unit pressure on a semiconductor wafer is disclosed in equation 1. The polishing unit pressure will not exceed the maximum allowable unit pressure under all operating conditions for the semiconductor wafer polishing process.

$$\text{Maximum Unit Pressure}=11{,}000 \text{ kilograms/meter}^2 \quad (1)$$

A nominal polishing unit pressure on a semiconductor wafer is disclosed in equation 2. The nominal polishing unit pressure is listed as half of the maximum unit pressure, but will vary for different polishing processes.

$$\text{Nominal Unit Pressure}=5{,}500 \text{ kilograms/meter}^2 \quad (2)$$

The compressive strength (CS) of PPS, Delrin®, and PEEK at ten percent deformation is listed in equation 3.

$$\text{PPS(CS)}=15{,}116{,}650 \text{ kilograms/meter}^2$$

$$\text{Delrin®(CS)}=11{,}249{,}600 \text{ kilograms/meter}^2$$

$$\text{PEEK(CS)}=14{,}062{,}000 \text{ kilograms/meter}^2 \quad (3)$$

The compressive modulus of elasticity (CME) of PPS, Delrin®, and PEEK is listed in equation 4.

$$\text{PPS(CME)}=302{,}333{,}000 \text{ kilograms/meter}^2$$

$$\text{Delrin®(CME)}=316{,}395{,}000 \text{ kilograms/meter}^2$$

$$\text{PEEK(CME)}=351{,}550{,}000 \text{ kilograms/meter}^2 \quad (4)$$

A first step in calculating the curvature of angular compliant device 53 is to determine the force that is applied to the second assembly. The force is determined by the maximum unit pressure on the semiconductor wafer multiplied by the surface area of the semiconductor wafer. The force is calculated for a 200 millimeter wafer and a 300 millimeter wafer as disclosed in equation 5.

$$\text{200 millimeter wafer}=345.4 \text{ kilograms}$$

$$\text{300 millimeter wafer}=777.7 \text{ kilograms} \quad (5)$$

The nominal force is half the maximum force as shown in equation 6.

$$\text{200 millimeter wafer}=172.7 \text{ kilograms}$$

$$\text{300 millimeter wafer}=388.9 \text{ kilograms} \quad (6)$$

A safety factor is incorporated in the design of angular compliant device 53 to ensure that the area generated by the compression of angular compliant device has a compressive stress significantly less than the material compressive strength at nominal pressure. For example, angular compliant device 53 being designed for 50 percent of the material compressive strength provides a significant margin of safety in the design to prevent plastic deformation.

By way of example, the material Delrin® is used to illustrate calculations for the spherical design of angular compliant device 53. Calculations for the other materials are performed similarly. One half of the material compressive strength of Delrin® is disclosed in equation 7.

$$\text{50\% of Delrin® CS}=5{,}624{,}800 \text{ kilograms/meter}^2 \quad (7)$$

Angular compliant device 53 made of Delrin® is compressed by contact with cover plate 55. The area contacting cover plate 55 is circular due to the spherical shape of angular compliant device 53. As mentioned previously, cover plate 55 rolls across the surface of angular compliant device 53 as the second assembly inclines to make the surface of semiconductor wafer 59 coplanar with the surface of the polishing media. The rolling motion allows the second assembly to incline freely in relation to the first assembly. The rolling motion is hindered as the contact area of angular compliant device 53 increases and will eventually prevent rolling if the contact area is made too large. In general, the contact area is made as small as possible. The contact area also varies with the pressure applied to the second assembly during the polishing process. The contact area of angular compliant device 53 is designed to allow a rolling motion for angular compliance while preventing plastic deformation under all operating conditions. For example, empirically determined information has shown that the rolling motion is maintained for a spherical angular compliant device made of Delrin® when the compression of the sphere is limited to a depth (h) of less than approximately 0.0001 meters.

In an embodiment of angular compliant device 53, the depth of compression under nominal down force for the polishing process is selected to be 0.00005 meters. As described hereinabove, a safety factor of two (under nominal down force) is used to ensure the compressive strength of the material (Delrin®) is not exceeded to prevent plastic deformation of angular compliant device 53. The contact area is determined by equating the nominal down force per area to one half of the compressive strength of Delrin® and solving for the area (X meters$^2$). Equation 8 determines the contact area (for Delrin®) for a 200 millimeter wafer.

$$172.7 \text{ (kilograms)/X meters}^2=5{,}624{,}800 \text{ kilograms/meters}^2$$

$$X=0.0000307 \text{ meters}^2 \quad (8)$$

Equation 9 determines the contact area (for Delrin®) for a 300 millimeter wafer.

$$388.9 \text{ (kilograms)/X meters}^2=5{,}624{,}800 \text{ kilograms/meters}^2$$

$$X=0.0000691 \text{ meters}^2 \quad (9)$$

The circular segment formula is used to determine the radius of the sphere for angular compliant device 53. The circular segment formula equates the radius ($r_{sphere}$) of the sphere to the depth (h) of compression under nominal down force and the length (c) of a segment bisecting the sphere at the depth h. As stated hereinabove, the compression depth h selected for this embodiment is 0.00005 meters. Equation 10 is the circular segment formula.

$$r_{sphere}=(c^2+4*h^2)/(8*h) \quad (10)$$

The segment bisecting the sphere corresponds to the diameter contact area of angular compliant device 53 under nominal down force. The segment defines the diameter of a circular contact area of the flattened sphere. The area of a circle is pi*(radius)$^2$. The segment (c) corresponds to the diameter of the circle which is twice the circle radius ($r_{circle}$) The size of the contact area is defined respectively for the 200 millimeter wafer and 300 millimeter wafer in equations 8 and 9. Thus, the radius of the circle is solved knowing the contact area which yields the length of the segment. The radius ($r_{circle}$) of the circle and the segment length for a 200 millimeter wafer is disclosed in equation 11.

$$X=0.0000307 \text{ meters}^2=\text{pi}*(r_{circle})^2$$

$$r_{circle}=0.00311 \text{ meters}$$

$$c(200 \text{ millimeter wafer})=2*r_{circle}=0.00622 \text{ meters} \quad (11)$$

The radius ($r_{circle}$) of the circle and the segment length for a 300 millimeter wafer is disclosed in equation 12.

$$X=0.0000691 \text{ meters}^2=\text{pi}*(r_{circle})^2$$

$$r_{circle}=0.00468 \text{ meters}$$

$$c(300 \text{ millimeter wafer})=2*r_{circle}=0.00936 \text{ meters} \quad (12)$$

Both the depth (h) of compression and the segment length are known. The radius $r_{sphere}$ is calculated using the circular segment formula disclosed in equation 10. The radius $r_{sphere}$ for a 200 millimeter wafer is disclosed in equation 13.

$$r_{sphere}=(0.00622^2+4*0.00005^2)/(8*0.00005)=0.096 \text{ meters} \quad (13)$$

The radius $r_{sphere}$ for a 300 millimeter wafer is disclosed in equation 14.

$$r_{sphere}=(0.00936^2+4*0.00005^2)/(8*0.00005)=0.219 \text{ meters} \quad (14)$$

Thus, the radius of the sphere forming angular compliant device 53 has been defined for both 200 and 300 millimeter wafers. The design allows cover plate 55 to roll across the surface of angular compliant device 53 without putting the material into plastic deformation. Carrier assembly 51 inclines freely, distributes pressure evenly across the surface of semiconductor wafer 59, rotates, and will provide uniform polishing for thousands of wafers. Typically, angular compliant device 53 is replaced during a normal maintenance schedule for a chemical mechanical planarization tool.

Figure 5:
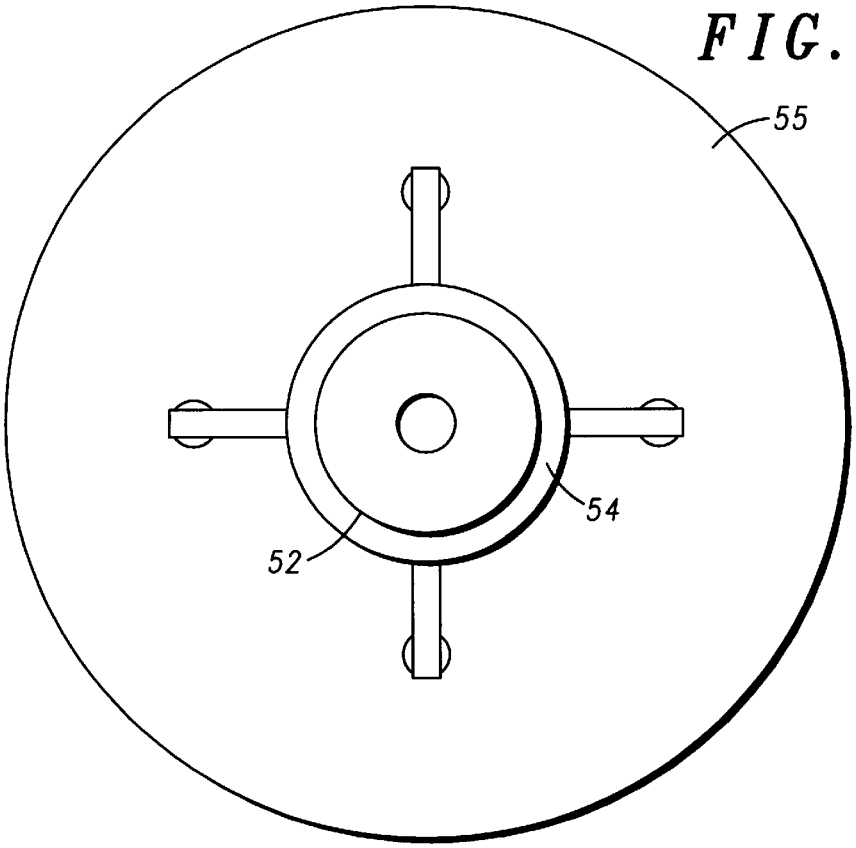
FIG. 5 is a top view the carrier assembly of FIG. 4 illustrating a drive mechanism for rotational motion.

FIG. 5 is a top view of carrier assembly 51 of FIG. 4 illustrating drive mechanism 54 for rotational motion. Drive shaft 52 extends vertically from and substantially perpendicular to the surface of cover plate 55. Drive shaft 52 is located centrally to cover plate 55. Drive shaft 52 is not rigidly connected to cover plate 55.

Drive mechanism 54 connects to drive shaft 52. Drive shaft 52 rotates drive mechanism 54. Four arms extend outward from drive mechanism 54. Each arm is placed 90 degrees from an adjacent arm. Each arm has a 90 degree bend that orients the arm in a vertical direction downward toward cover plate 55. Each arm of drive mechanism 54 extends through an opening in cover plate 55 into a cavity formed in carrier plate 56 (not shown). The four openings are concentrically located on cover plate 55. Each arm ends in a sphere which contacts a side wall (typically a flat surface) of carrier plate 56 to couple rotational motion from drive shaft 52 to the second assembly of carrier assembly 51. The sphere shape is used to minimize contact area between the sphere and the sidewall of carrier plate 56. Minimizing contact area reduces friction which allows the second assembly to incline freely. Also, the spherical ends allow angular compliance without a change in contact area.

Figure 6:
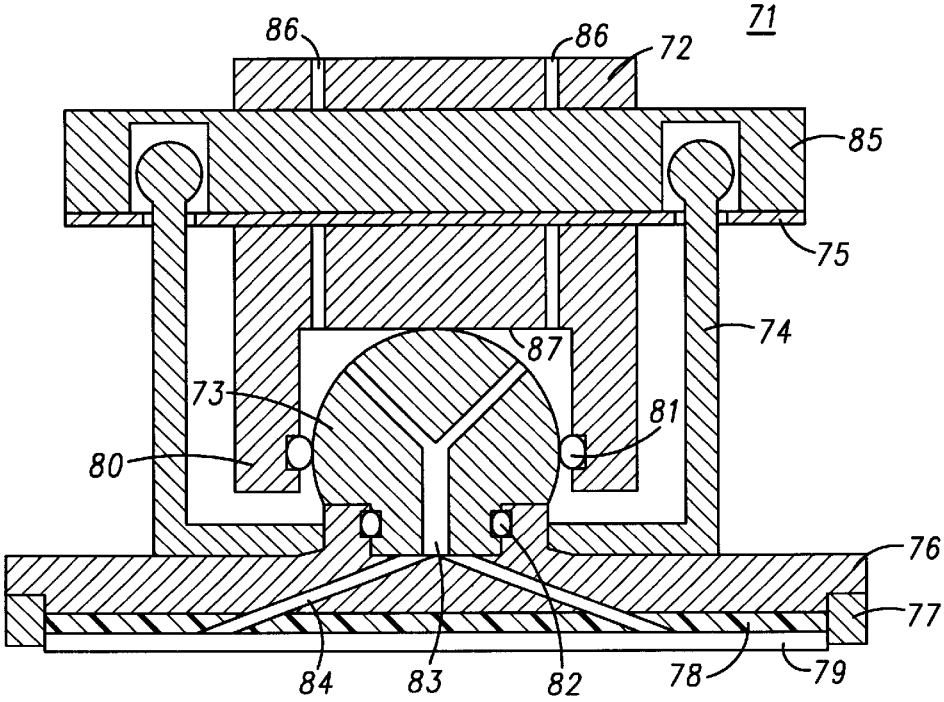
FIG. 6 is a cross-sectional view of an alternate embodiment of a carrier assembly in accordance with the present invention.

FIG. 6 is a cross-sectional view of an alternate embodiment of a carrier assembly 71 in accordance with the present invention. Carrier assembly 71 comprises a first assembly and a second assembly. In principle, the design is similar to that shown in FIG. 4 except that the flat and curved surfaces, which allow the apparatus to incline freely, are reversed. The flat surface is on the first assembly while the curved surface is on the second assembly. The design calculations for the sphere of the second assembly are identical to that disclosed in FIG. 4 because the operating conditions and contact area between the curved and flat surface are equal. The design permits the second assembly to incline freely in any direction to ensure the surface of a semiconductor wafer 79 is coplanar to a surface of a polishing media (not shown). The second assembly applies equal pressure across the entire surface of semiconductor wafer 79 such that material is uniformly removed during the polishing process.

The first assembly comprises a drive shaft 72, a drive plate 85, and a cover plate 75. Drive shaft 72 is connected to a motor assembly (not shown) for rotating carrier assembly 71. Drive shaft 72 includes channels 86 for providing a gas or vacuum to the second assembly. In an embodiment of carrier assembly 71, a housing 80 is formed in the end of drive shaft 72. Housing 80 includes a flat surface 87, which is used for angular compensation. Drive plate 85 is circular in shape, and centrally connects to drive shaft 72 for providing rotational motion to the second assembly.

The second assembly comprises an angular compliant device 73, a drive mechanism 74, a carrier plate 76, a carrier ring 77, and a carrier film 78. Carrier plate 76 is a support structure for a semiconductor wafer 79 during a polishing process. Carrier film 78 is a compliant material that resides between semiconductor wafer 79 and carrier plate 76. Carrier ring 77 connects to carrier plate 76. Carrier ring 77 provides a surface that retains semiconductor wafer 79 from moving off the second assembly during the polishing process. It also keeps semiconductor wafer 79 concentric to assembly 71.

Drive mechanism 74 connects to an upper surface of carrier plate 76 and includes a structure that contacts the first assembly for rotating the second assembly. In an embodiment of drive mechanism 74 a drive spider is employed to rotate the second assembly. The drive spider has four arms that are concentrically located to the second assembly. Each arm is located 90 degrees from an adjacent arm for providing balanced drive to the second assembly. More arms can be employed to reduce the load to each arm if desired. As shown, each of the spider drive ends preferably terminate in a sphere or the like. The sphere fits into a cavity in the first assembly. Openings are formed in cover plate 75 and drive plate 85 which correspond to each arm. The cavities are formed in drive plate 85. The side walls and bottom of each cavity are spaced such that the second assembly inclines freely. Rotating drive shaft 72 causes each sphere of the drive spider to contact a corresponding side wall of each cavity to rotate the second assembly.

Angular compliant device 73 fits into a housing formed on the upper surface of carrier plate 76. Angular compliant device includes a passageway 83 for providing vacuum or gas. An o-ring 82 seals angular compliant device 73 to the housing of carrier plate 76. The second assembly inclines across the curved surface of angular compliant device 73 The pressure at which the surface of semiconductor wafer 79 contacts a surface of the polishing media is transmitted through the contacting area of angular compliant device 73 to flat surface 87 in housing 80. Angular compliant device 73 is sealed to housing 80 via an o-ring 81 thereby connecting channels 86 to passageway 83.

Passageways 84 are formed through carrier plate 76 and carrier film 78. Passageways 84 connect to passageway 83. Vacuum or gas provided to the first assembly is coupled to the second assembly via channels 86, passageway 83, and passageways 84. Vacuum is used to hold semiconductor wafer 79 to carrier film 78 during the polishing process. Gas, for example nitrogen, is used to eject semiconductor wafer 79 from carrier assembly 71 after polishing to a wafer carrier for holding polished wafers.

The second assembly inclines freely as semiconductor wafer 79 is pressed against the polishing media. The second assembly inclines such that the exposed surface of semiconductor wafer 79 is coplanar to the surface of the polishing media. Angular compliant device 73 rolls across flat surface 87 in housing 80 to provide angular compensation. The contact area of angular compliant device 73 to flat surface 87 is designed to compress under pressure applied for polishing. The material selected for angular compliant device 73 deforms, but is designed to undergo only elastic deformation.

Figure 7:
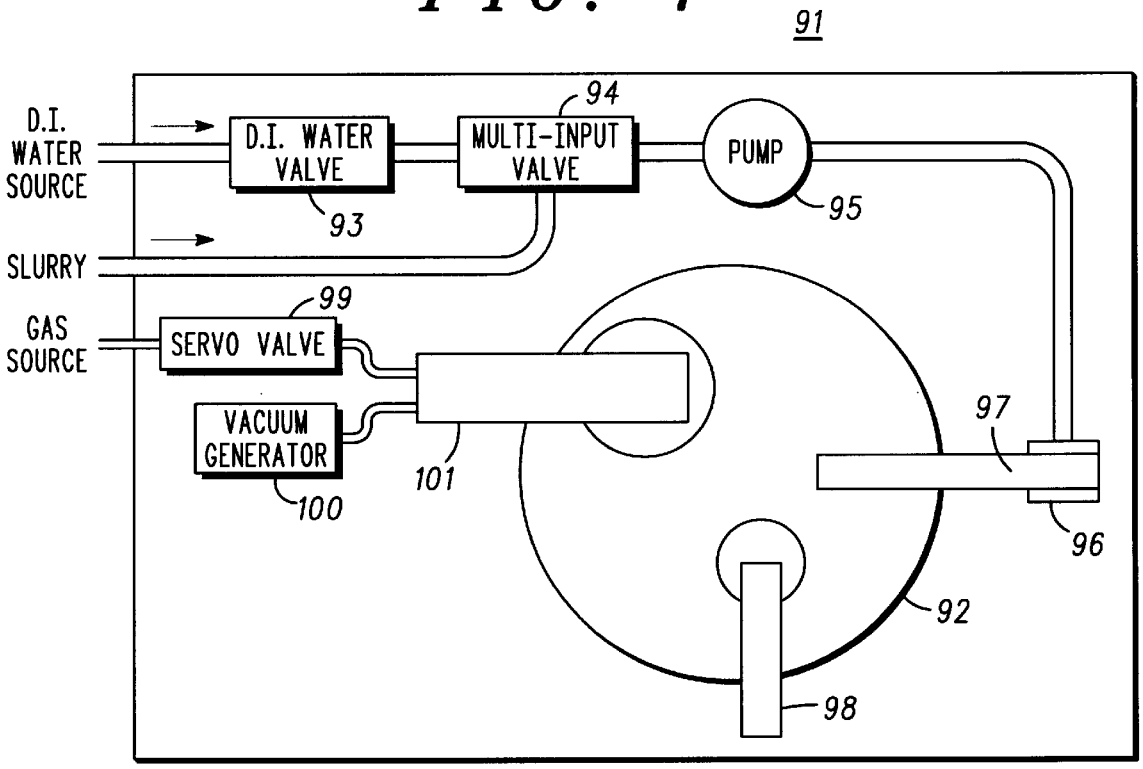
FIG. 7 is a top view of a chemical mechanical planarization tool in accordance with the present invention.

FIG. 7 is a top view of a chemical mechanical planarization (CMP) tool 91 in accordance with the present invention. CMP tool 91 comprises a platen 92, a deionized (DI) water valve 93, a multi-input valve 94, a pump 95, a dispense bar manifold 96, a dispense bar 97, a conditioning arm 98, a servo valve 99, a vacuum generator 100, and a wafer carrier arm 101.

Platen 92 supports various polishing media and chemicals used to planarize a processed side of a semiconductor wafer. Platen 92 is typically made of metal such as aluminum or stainless steel. A motor (not shown) couples to platen 92. Platen 92 is capable of rotary, orbital, or linear motion at user-selected surface speeds.

Deionized water valve 93 has an input and an output. The input is coupled to a DI water source. Control circuitry (not shown) enables or disables DI water valve 93. DI water is provided to multi-input valve 94 when DI water valve 93 is enabled. Multi-input valve 94 allows different materials to be pumped to dispense bar 97. An example of the types of materials which are input to multi-input valve 94 are chemicals, slurry, and deionized water. In an embodiment of CMP tool 91, multi-input valve 94 has a first input coupled to the output of DI water valve 93, a second input coupled to a slurry source, and an output. Control circuitry (not shown) disables all the inputs of multi-input valve 94 or enables any combination of valves to produce a flow of selected material to the output of multi-input valve 94.

Pump 95 pumps material received from multi-input valve 94 to dispense bar 97. The rate of pumping provided by pump 95 is user-selectable. Minimizing flow rate variation over time and differing conditions permits the flow to be adjusted near the minimum required flow rate, which reduces waste of chemicals, slurry, or DI water. Pump 95 has an input coupled to the output of multi-input valve 94 and an output.

Dispense bar manifold 96 allows chemicals, slurry, or DI water to be routed to dispense bar 97. Dispense bar manifold 96 has an input coupled to the output of pump 95 and an output. An alternate approach utilizes a pump for each material being provided to dispense bar 97. For example, chemicals, slurry, and DI water each have a pump that couples to dispense bar manifold 96. The use of multiple pumps allows the different materials to be precisely dispensed in different combinations by controlling the flow rate of each material by its corresponding pump. Dispense bar 97 distributes chemicals, slurry, or DI water onto a polishing media surface. Dispense bar 97 has at least one orifice for dispensing material onto the polishing media surface. Dispense bar 97 is suspended above and extends over platen 92 to ensure material is distributed over the majority of the surface of the polishing media.

Wafer carrier arm 101 suspends a semiconductor wafer over the polishing media surface. Wafer carrier arm 101 applies a user-selectable down force onto the polishing media surface. In general, wafer carrier arm 101 is capable of rotary motion as well as a linear motion. A semiconductor wafer is held onto a wafer carrier by vacuum. Wafer carrier arm 101 has a first input and a second input.

Vacuum generator 100 is a vacuum source for wafer carrier arm 101. Vacuum generator 100 generates and controls vacuum used for wafer pickup by the wafer carrier. Vacuum generator 100 is not required if a vacuum source is available from the manufacturing facility. Vacuum generator 100 has a port coupled to the first input of wafer carrier arm 101. Servo valve 99 provides a gas to wafer carrier arm 101 for wafer ejection after the planarization is complete. The gas is also used to put pressure on the backside of a wafer during planarization to control the wafer profile. In an embodiment of CMP tool 91, the gas is nitrogen. Servo valve 99 has an input coupled to a nitrogen source and an output coupled to the second input of wafer carrier arm 101.

Conditioning arm 98 is used to apply an abrasive end effector onto a surface of the polishing media. The abrasive end effector planarizes the polishing media surface and cleans and roughens the surface to aid in chemical transport. Conditioning arm 98 typically is capable of both rotational and translational motion. The pressure or down force in which the end effector presses onto the surface of the of the polishing media is controlled by conditioning arm 98.

Figure 8:
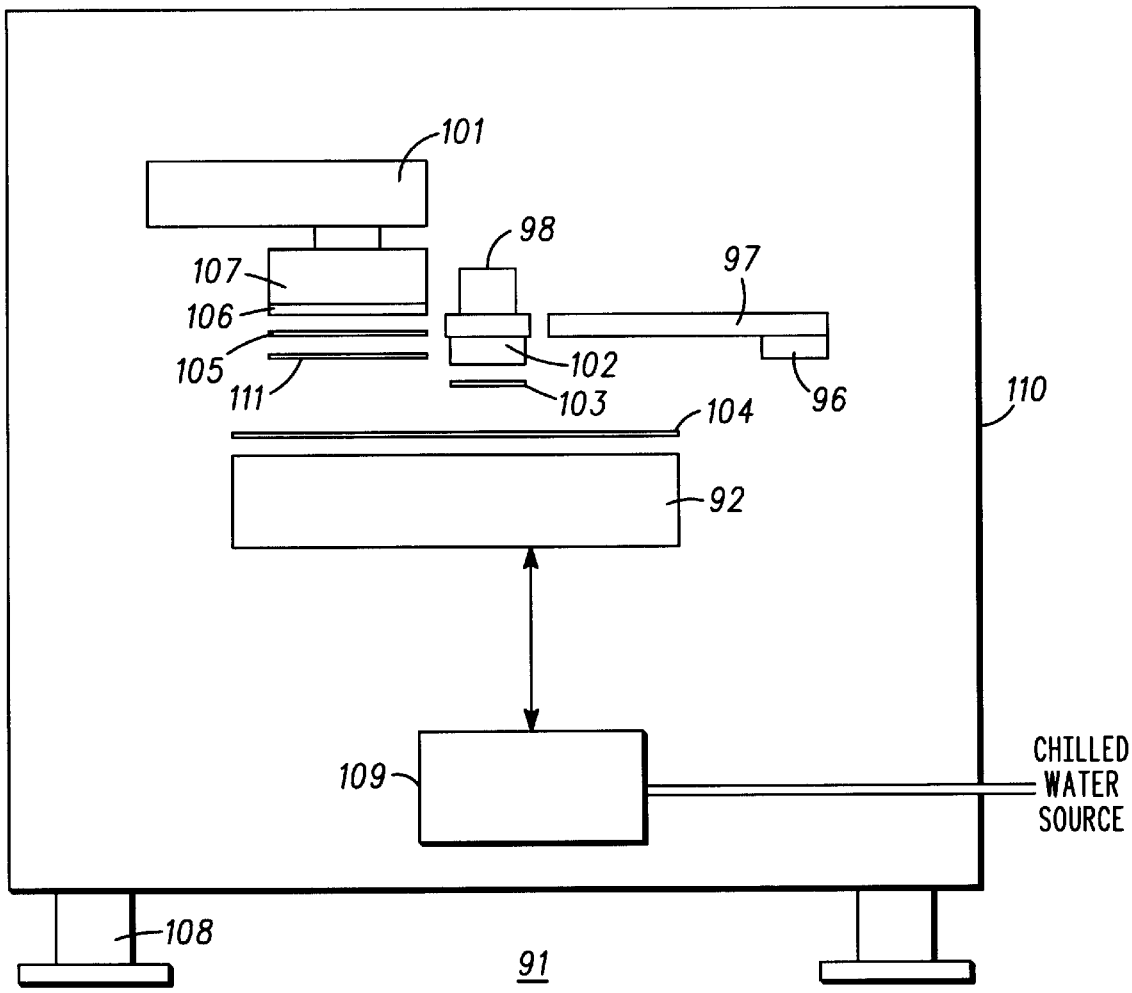
FIG. 8 is a side view of the chemical mechanical planarization tool of FIG. 7 in accordance with the present invention.

FIG. 8 is a side view of the chemical mechanical planarization (CMP) tool 91 shown in FIG. 7. As shown in FIG. 8, conditioning arm 98 includes a pad conditioner coupling 102 and an end effector 103. CMP tool 91 further includes a polishing media 104, a carrier assembly 107, machine mounts 108, a heat exchanger 109, an enclosure 110, and a semiconductor wafer 111.

Polishing media 104 is placed on platen 92. Typically, polishing media 104 is attached to platen 92 using a pressure sensitive adhesive. Polishing media 104 provides a suitable surface upon which to introduce a polishing chemistry. Polishing media 104 provides for chemical transport and micro-compliance for both global and local wafer surface irregularities. Typically, polishing media 104 is a polyurethane pad, which is compliant and includes small perforations or annular groves throughout the exposed surface for chemical transport.

Carrier assembly 107 couples to wafer carrier arm 101. Carrier assembly 107 provides a foundation with which to rotate semiconductor wafer 111 in relation to platen 92. Carrier assembly 107 also puts a downward force on semiconductor wafer 111 to hold it against polishing media 104. According to the present invention, carrier assembly 107 is described in detail in FIGS. 4, 5, and 6. A motor (not shown) allows user controlled rotation of carrier assembly 107. Carrier assembly 107 comprises a first assembly and a second assembly. The second assembly inclines freely in relation to the first assembly for providing angular compensation. Carrier assembly 107 includes vacuum and gas pathways to hold semiconductor wafer 111 during planarization, profile semiconductor wafer 111, and eject semiconductor wafer 111 after planarization.

A carrier film 105 and a carrier ring 106 is shown in the illustration of carrier assembly 107. Carrier ring 106 is a component of the second assembly of carrier assembly 107. Carrier ring 106 aligns semiconductor wafer 111 concentrically to the second assembly and physically constrains semiconductor wafer 111 from moving laterally. Carrier film 105 is a component of the support structure of the second assembly of carrier assembly 107. Carrier film 105 provides a surface for semiconductor wafer 111 with suitable frictional characteristics to prevent rotation due to slippage in relation to carrier assembly 107 during planarization. In addition, the carrier film is slightly compliant as an aid to the planarization process.

Pad conditioner coupling 102 couples to conditioning arm 98. Pad conditioner coupling 102 allows angular compliance between platen 92 and end effector 103. End effector 103 abrades polishing media 104 to achieve flatness and aid in chemical transport to the surface of semiconductor wafer 111 being planarized.

Chemical reactions are sensitive to temperature. It is well known that the rate of reaction typically increases with temperature. In chemical mechanical planarization, the temperature of the planarization process is held within a certain range to control the rate of reaction. The temperature is controlled by heat exchanger 109. Heat exchanger 109 is coupled to platen 92 for both heating and cooling. For example, when first starting a wafer lot for planarization the temperature is approximately room temperature. Heat exchanger 109 heats platen 92 such that the CMP process is above a predetermined minimum temperature to ensure a minimum chemical reaction rate occurs. Typically, heat exchanger 109 uses ethylene glycol as the temperature transport/control mechanism to heat or cool platen 92. Running successive wafers through a chemical mechanical planarization process produces heat, for example, carrier assembly 107 retains heat. Elevating the temperature at which the CMP process occurs increases the rate of chemical reaction. Cooling platen 92 via heat exchanger 109 ensures that the CMP process is below a predetermined maximum temperature such that a maximum reaction is not exceeded.

Machine mounts 108 raise chemical mechanical planarization tool 91 above floor level to allow floor mounted drip pans when they are not integral to the polishing tool. Machine mounts 108 also have an adjustable feature to level CMP tool 91 and are designed to absorb or isolate vibrations.

Chemical mechanical planarization tool 91 is housed in an enclosure 110. As stated previously, the CMP process uses corrosive materials harmful to humans and the environment. Enclosure 110 prevents the escape of particulates and chemical vapors. All moving elements of CMP tool 91 are housed within enclosure 110 to prevent injury.

Operation of chemical mechanical planarization tool 91 is described hereinafter. No specific order of steps is meant or implied in the operating description as they are determined by a large extent to the type of semiconductor wafer polishing being implemented. Heat exchanger 109 heats platen 92 to a predetermined temperature to ensure chemicals in the slurry have a minimum reaction rate when starting a chemical mechanical planarization process. A motor drives platen 92 thereby placing polishing media 104 in one of rotational, orbital, or linear motion.

Wafer carrier arm 101 moves to pick up semiconductor wafer 111 located at a predetermined position. The vacuum generator is enabled to provide vacuum to carrier assembly 107. Carrier assembly 107 is aligned to semiconductor wafer 111 and moved such that a surface of carrier assembly contacts the unprocessed side of semiconductor wafer 111. Carrier film 105 is attached to the surface of carrier assembly 107. Both the vacuum and carrier film 105 hold semiconductor wafer 111 to the surface of carrier assembly 107. Carrier ring 106 constrains semiconductor wafer 111 centrally on the surface of carrier assembly 107.

Multi-input valve 94 is enabled to provide slurry to pump 95. Pump 95 provides the slurry to dispense bar manifold 96. The slurry flows through dispense bar manifold 96 to dispense bar 97 where it is delivered to the surface of polishing media 104. Periodically, deionized water valve 93 is opened to provide water through dispense bar 97 to displace the slurry to prevent it from drying, settling, or agglomerating in dispense bar 97. The motion of platen 92 aids in distributing the polishing chemistry throughout the surface of polishing media 104. Typically, slurry is delivered at a constant rate throughout the polishing process.

Wafer carrier arm 101 then returns to a position over polishing media 104. Wafer carrier arm 101 places semiconductor wafer 111 in contact with polishing media 104. Carrier assembly 107 provides angular compensation thereby placing the surface of semiconductor wafer 111 coplanar to the surface of polishing media 104. Polishing chemistry covers polishing media 104. Wafer carrier arm 101 puts down force on semiconductor wafer 111 to promote friction between the slurry and semiconductor wafer 111. Polishing media 104 is designed for chemical transport which allows chemicals of the slurry to flow under semiconductor wafer 111 even though it is being pressed against the polishing media. As heat builds up in the system, heat exchanger 109 changes from heating platen 92 to cooling platen 92 to control the rate of chemical reaction.

It should be noted that it was previously stated that platen 92 is placed in motion in relation to semiconductor wafer 111 for mechanical polishing. Conversely, platen 92 could be in a fixed position and carrier assembly 107 could be placed in rotational, orbital, or translational motion. In general, both platen 92 and carrier assembly 107 are both in motion to aid in mechanical planarization.

Wafer carrier arm 101 lifts carrier assembly 107 from polishing media 104 after the chemical mechanical planarization process is completed. Wafer carrier arm 101 moves semiconductor wafer 111 to a predetermined area for cleaning. Wafer carrier arm 101 then moves semiconductor wafer 111 to a position for unloading. Vacuum generator 100 is then disabled and servo valve 99 is opened providing gas to carrier assembly 107 to eject semiconductor wafer 111.

Uniformity of the chemical mechanical planarization process is maintained by periodically conditioning polishing media 104, which is typically referred to as pad conditioning. Pad conditioning promotes the removal of slurry and particulates that build up and become embedded in polishing media 104. Pad conditioning also planarizes the surface and roughens the nap of polishing media 104 to promote chemical transport. Pad conditioning is achieved by conditioning arm 98. Conditioning arm 98 moves end effector 103 into contact with polishing media 104. End effector 103 has a surface coated with industrial diamonds or some other abrasive which conditions polishing media 104. Pad conditioner coupling 102 is between conditioning arm 98 and end effector 103 to allow angular compliance between platen 92 and end effector 103. Conditioning arm 98 is capable of rotary and translational motion to aid in pad conditioning. Pad conditioning is done during a planarization process, between wafer starts, and to condition a new pad prior to wafer processing.

By now it should be appreciated that a carrier assembly for a chemical mechanical planarization system and a method of polishing has been disclosed. The carrier assembly has a first assembly and a second assembly. The first assembly is attached to a translation mechanism that allows the carrier assembly to be moved to different locations in the chemical mechanical planarization tool.

The second assembly is connected to the first assembly. A surface of a semiconductor wafer is exposed for polishing by the second assembly. The exposed surface of the semiconductor wafer is placed in contact with a surface of a polishing media. The second assembly inclines freely for angular compliance. One of the first or second assembly has a curved surface. The remaining assembly has a flat surface in contact with the curved surface. The second assembly rolls across the first assembly (via contact between the flat and curved surfaces) until the surface of the semiconductor wafer is coplanar to and coincident with the surface of said polishing media. Uniform pressure applied to the surface of the semiconductor wafer is transferred ideally through the point contact between the curved and flat surface. In practice, the curved surface undergoes elastic compression resulting in a small contact area (essentially a point contact). The small contact area is minimal and allows a rolling motion to be achieved which produces a wafer carrier assembly having a second assembly which inclines freely in any direction in relation to a first assembly. The result is a wafer carrier assembly that applies uniform pressure across a semiconductor wafer surface during a polishing process. One or both of the polishing media and the carrier assembly undergoes rotational, orbital, or linear motion. The movement in conjunction with a polishing slurry (abrasives and chemicals) uniformly removes material from the semiconductor wafer. The carrier assembly is easily adaptable to larger semiconductor wafer sizes and provides better polishing uniformity than prior art carrier assemblies.

What is claimed is:

1. A semiconductor wafer carrier assembly comprising:

a first assembly having a first surface; and a second assembly having a second surface, wherein said first surface and said second surface contact one another at a contact area for bringing a semiconductor wafer coplanar to and coincident with a polishing media, wherein said contact is between a curved surface and a flat surface allowing said second assembly to move in relation to said first assembly to achieve angular compliance, and wherein said second assembly comprises a first passage way.

2. The semiconductor wafer carrier assembly of claim 1 wherein one of the semiconductor wafer carrier assembly and said polishing media is capable of one of rotational, orbital, and linear motion.

3. The semiconductor wafer carrier assembly of claim 1 wherein a uniform pressure applied across a surface of said semiconductor wafer is transmitted substantially through said contact area between said first surface and said second surface.

4. The semiconductor wafer carrier assembly of claim 3 wherein said curved surface comprises a deformable material in said contact area and wherein said flat surface comprises a material that does not substantially deform in said contact area.

5. The semiconductor wafer carrier assembly of claim 4 wherein said curved surface comprises one of polyphenylene sulfide, homopolymeracetal, and polyetheretherketone.

6. The semiconductor wafer carrier assembly of claim 4 wherein deformation of said curved surface is elastic deformation at a point contact.

7. The semiconductor wafer carrier assembly of claim 4 wherein said flat surface comprises a hardened metal.

8. The chemical mechanical planarization tool as recited in claim 1 wherein said second assembly comprises a second passage way for providing a gas, wherein said first passage way provides for said gas and wherein the first passage way and second passage way are coupled.

9. The chemical mechanical planarization tool as recited in claim 1 wherein said second assembly comprises a second passage way for providing a vacuum, wherein said first passage way provides for said vacuum, and wherein the first passage way and second passage way are coupled.

10. A chemical mechanical planarization tool comprising:

a dispense device for providing materials used in a polishing process;

a platen;

a polishing media on said platen for receiving said materials; and a wafer carrier device including a first assembly; and a second assembly coupled to said first assembly, wherein uniform pressure applied to a surface of a semiconductor wafer in said polishing process is coupled through a contact area between said fist and second assembly, wherein said contact area comprises a stationary curved surface in contact with a flat surface, wherein said contact is substantially a point contact, and wherein said second assembly comprises a passage way.

11. The chemical mechanical planarization tool as recited in claim 10 wherein said second assembly inclines freely in a direction to bring said semiconductor wafer in angular compliance with the polishing media.

12. The chemical mechanical planarization tool as recited in claim 10 wherein said point contact is centrally located to said first and second assembly.

13. The chemical mechanical planarization tool as recited in claim 10 wherein said curved surface comprises a material that deforms at said point contact and wherein said flat surface comprises a material that does not substantially deform at said point contact.

14. The chemical mechanical planarization tool as recited in claim 13 wherein deformation of said curved surface is elastic deformation.

15. The chemical mechanical planarization tool as recited in claim 10 wherein said curved surface comprises a plastic material selected from a group consisting of polyphenylene sulfide, homopolymeracetal, and polyetheretherketone.

16. The chemical mechanical planarization tool as recited in claim 10 wherein said flat surface comprises a hardened stainless steel.

17. The chemical mechanical planarization tool as recited in claim 10 wherein said first assembly comprises:

a drive shaft;

a drive mechanism coupled to said drive shaft; and an angular compliant device coupled to said drive shaft wherein said angular compliant device has said curved surface.

18. The chemical mechanical planarization tool as recited in claim 10 wherein said second assembly comprises:

a cover plate having said flat surface;

a carrier plate coupled to said cover plate;

a carrier film coupled to said cover plate; and a carrier ring coupled to said carrier wherein a drive mechanism of said first assembly couples to said second assembly for rotating said second assembly.

19. A method for polishing a semiconductor wafer comprising the steps of:

providing a wafer carrier assembly comprising a first assembly coupled to a second assembly;

coupling a semiconductor wafer to said second assembly;

moving said wafer carrier assembly such that an exposed surface of the semiconductor wafer contacts a polishing media;

bringing said exposed surface coplanar to and coincident with a surface of said polishing media by moving said second assembly freely in a direction about a point contact between a flat surface and a curved surface formed by said second assembly and said first assembly, wherein said second assembly comprises a passage way;

applying uniform pressure across said exposed surface of the semiconductor wafer through said contact area; and removing material from said exposed surface of the semiconductor wafer.

20. The method as recited in claim 19 wherein said step of bringing said exposed surface coplanar to and coincident with the surface of said polishing media includes moving a surface of said second assembly across a surface of said first assembly to position said second assembly such that the semiconductor wafer is coplanar to and coincident with said surface of said polishing media.

21. The method of claim 19 wherein the step of coupling the semiconductor wafer to said second assembly further comprises:

applying a vacuum through a passage way formed in the second assembly to hold said semiconductor wafer.

22. The method of claim 19 further comprising the step of:

applying a gas through a passage way formed in the second assembly to apply a back pressure to the semiconductor wafer.

23. A semiconductor wafer carrier assembly comprising:

a first assembly having a first surface comprised of an elastic deformable material;

a second assembly having a second surface, wherein said first surface and said second surface contact one another for bringing a semiconductor wafer coplanar to and coincident with a polishing media, wherein said contact is between a curved surface and a flat surface allowing said second assembly to move in relation to said first assembly to achieve angular compliance, and wherein said second assembly comprises a first passage way.

* * * * *